US007864036B2

(12) United States Patent
Hanyu

(10) Patent No.: US 7,864,036 B2
(45) Date of Patent: Jan. 4, 2011

(54) INFORMATION PROCESSING APPARATUS AND METHOD OF CONTROLLING THE SAME

(75) Inventor: Tomohiro Hanyu, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 584 days.

(21) Appl. No.: 11/896,028

(22) Filed: Aug. 29, 2007

(65) Prior Publication Data

US 2008/0055053 A1 Mar. 6, 2008

(30) Foreign Application Priority Data

Aug. 31, 2006 (JP) ..... 2006-236856

(51) Int. Cl.
*G08B 29/00* (2006.01)
*G08B 5/00* (2006.01)

(52) U.S. Cl. ..... 340/506; 340/568.1; 340/686.1; 340/691.3; 340/692

(58) Field of Classification Search ..... 340/506, 340/691.3, 568.1, 686.1
See application file for complete search history.

(56) References Cited

U.S. PATENT DOCUMENTS

| | | | | |
|---|---|---|---|---|
| 5,317,304 | A * | 5/1994 | Choi | 340/571 |
| 6,970,095 | B1 * | 11/2005 | Lee et al. | 340/669 |
| 7,158,510 | B1 * | 1/2007 | Golla et al. | 370/374 |
| 7,218,226 | B2 * | 5/2007 | Wehrenberg | 340/571 |

FOREIGN PATENT DOCUMENTS

| | | |
|---|---|---|
| JP | 2003-150180 | 5/2003 |
| JP | 2005-110044 | 4/2005 |
| JP | 2005-242585 | 9/2005 |

* cited by examiner

*Primary Examiner*—Donnie L Crosland
(74) *Attorney, Agent, or Firm*—Pillsbury Winthrop Shaw Pittman, LLP

(57) ABSTRACT

According to one embodiment, an information processing apparatus, includes notice unit for raising an alarm to call attention, control unit for setting intensity associated with an attention degree of the alarm of the notice unit, detection unit for detecting a determined state, and execution unit for urging the notice unit to output the alarm, irrespective of setting the intensity by the control unit, if the predetermined state is detected by the detection unit.

10 Claims, 8 Drawing Sheets

INFORMATION PROCESSING APPARATUS AND METHOD OF CONTROLLING THE SAME

CROSS-REFERENCE TO RELATED APPLICATIONS

This application is based upon and claims the benefit of priority from Japanese Patent Application No. 2006-236856, filed Aug. 31, 2006, the entire contents of which are incorporated herein by reference.

BACKGROUND

1. Field

One embodiment of the present invention relates to an information processing apparatus capable of, upon detecting a predetermined state, sending a notice at any time irrespective of settings, and a method of controlling the information processing apparatus.

2. Description of the Related Art

As for a general technique of automatic notice as disclosed in, for example, JP-A No. 2003-150180 (KOKAI), there is a control technique of adjusting or automatically adjusting the same sound sources for different notice purposes at respective appropriate volumes (cf. JP-A No. 2003-150180 (KOKAI)).

According to this technique, however, when an important notice is sent, unnecessary control of a notice unit is executed, an important notice is not set or setting of intensity of the notice unit is so small that the notice cannot be sent.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an information processing apparatus, includes notice unit for raising an alarm to call attention; control unit for setting intensity associated with an attention degree of the alarm of the notice unit; detection unit for detecting a determined state; and execution unit for urging the notice unit to output the alarm, irrespective of setting the intensity by the control unit, if the predetermined state is detected by the detection unit.

First Embodiment

An embodiment of the present invention will be described below with reference to the accompanying drawings.

Figure 1:
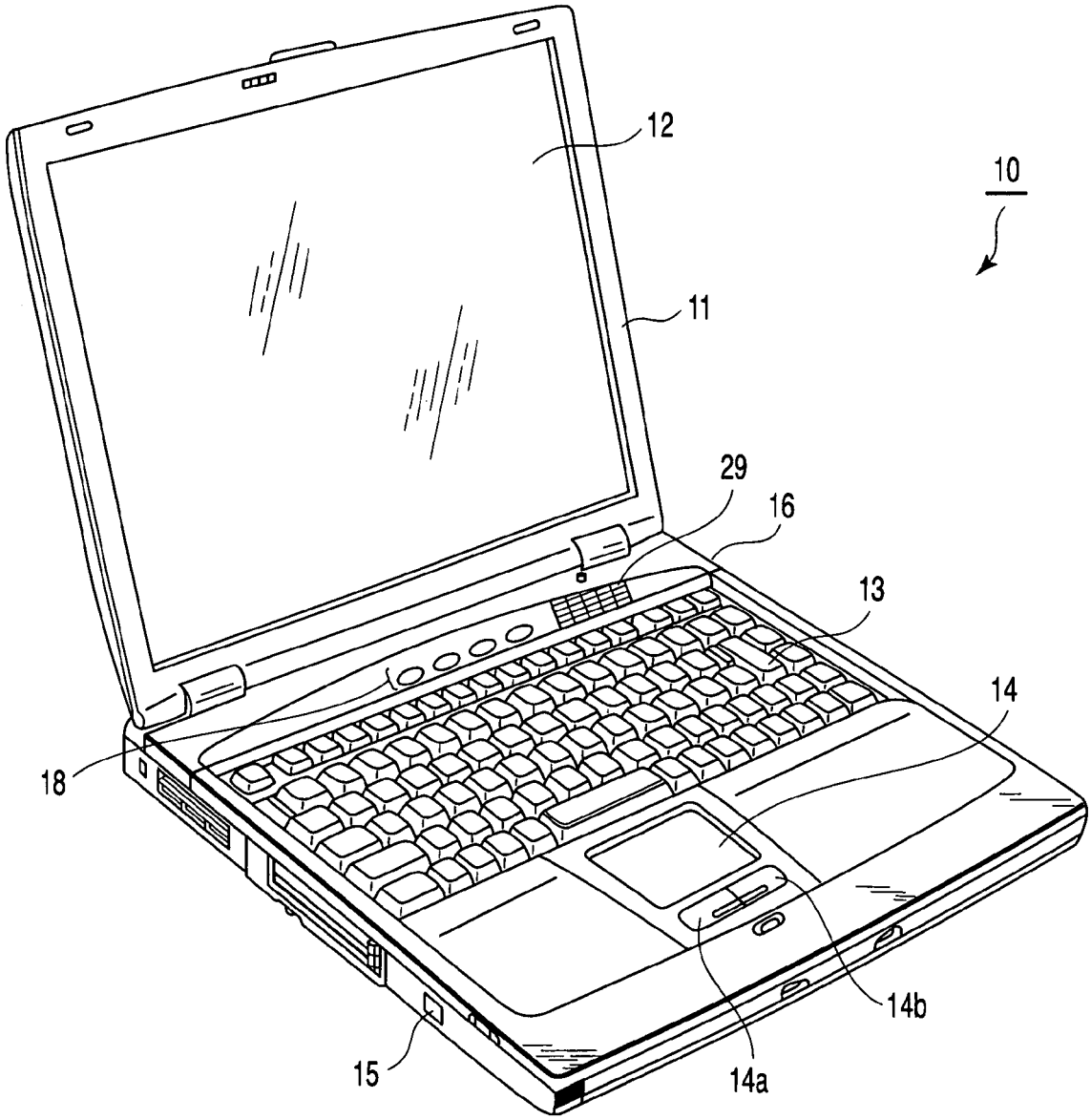
FIG. 1 is an exemplary perspective view showing an outer appearance of an information processing apparatus according to a first embodiment of the present invention.

FIG. 1 is a perspective view showing an information processing apparatus according to a first embodiment of the present invention. The information processing apparatus is implemented as a battery-operated notebook computer 10. In the present invention, when notice of an abnormal state detected by a sensor (i.e. an alarm to call intention) is sent, a predetermined notice is set at any time even if setting of notice unit is OFF.

The computer 10 is composed of a main body 16 and a display unit 11 as shown in FIG. 1. A display device composed of an LCD (Liquid Crystal Display) is embedded in the display unit 11. A display screen 12 of the LCD is located approximately at the center of the display unit 11.

The display unit 11 is attached to the computer 10 so as to freely pivot between an opened position and a closed position. The main body of the computer 10 has a housing shaped in a thin box, and comprises a keyboard 13 on a top face, a touch pad 14 and two buttons 14*a*, 14*b*, various kinds of shortcut buttons 18 for mail and the like, a power button, a volume control button 18, a speaker 29 and the like on a palm rest. An optical drive 15 is provided on a side face of the main body 16.

Figure 2:
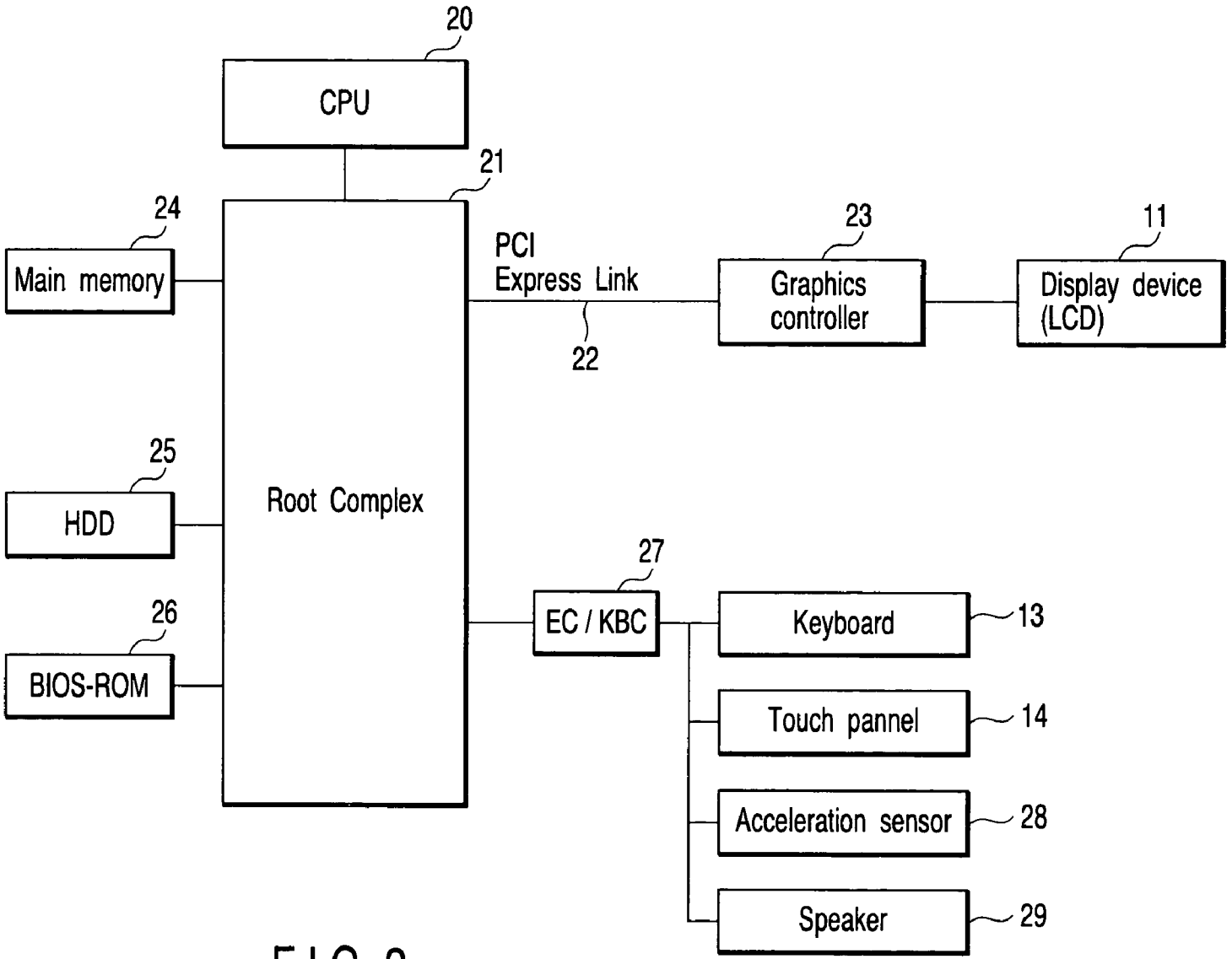
FIG. 2 is an exemplary block diagram showing main units of the information processing apparatus according to the first embodiment of the present invention.

FIG. 2 is a block diagram showing the main units of the information processing apparatus according to the first embodiment.

The computer 10 comprises a CPU (Central Processing Unit) 20, a Root Complex 21, a main memory 24, a graphics controller (End Point) 23, a PCI Express Link 22 making a connection between the Root Complex 21 and the graphics controller 23, the display unit 11 serving as the display (LCD), an embedded controller/keyboard controller IC (EC/KBC) 27, a hard disk drive (HDD) 25, a BIOS-ROM 26, the keyboard 13, the touch pad 14, an acceleration sensor 28, the speaker 29 and the like.

The Root Complex 21, the graphics controller 23, and the like are devices in conformity with the PCI EXPRESS standards. The communications between the Root Complex 21 and the graphics controller 23 are executed over the PCI Express Link 22 arranged between the Root Complex 21 and the graphics controller 23.

The CPU 20 is a processor controlling the operations of the computer 10, and executes various kinds of programs (operating system and application systems) loaded on the main memory 24 by the HDD 25. In addition, the CPU 20 also executes the BIOS (Basic Input Output System) stored in the BIOS-ROM 26. The BIOS is a program for controlling the hardware.

The Root Complex 21 is a bridge device making a connection between a local bus of the CPU 20 and the graphics controller 23. In addition, the Root Complex 21 also has a function of executing the communications with the graphics controller 23 over the PCI Express Link 22.

The graphics controller 23 is a display controller which controls the display unit 11 employed as a display monitor of the computer.

The EC/KBC 27 is a one-chip microcomputer on which an embedded controller for power management and a keyboard controller controlling the keyboard 13, the touch pad 14, the acceleration sensor 28, the speaker 29 and the like are integrated. The EC/KBC 27 has a function of controlling power-on/power-off of the computer 10, in cooperation with a power supply controller, in response to the user's operation of the power button.

Figure 3:
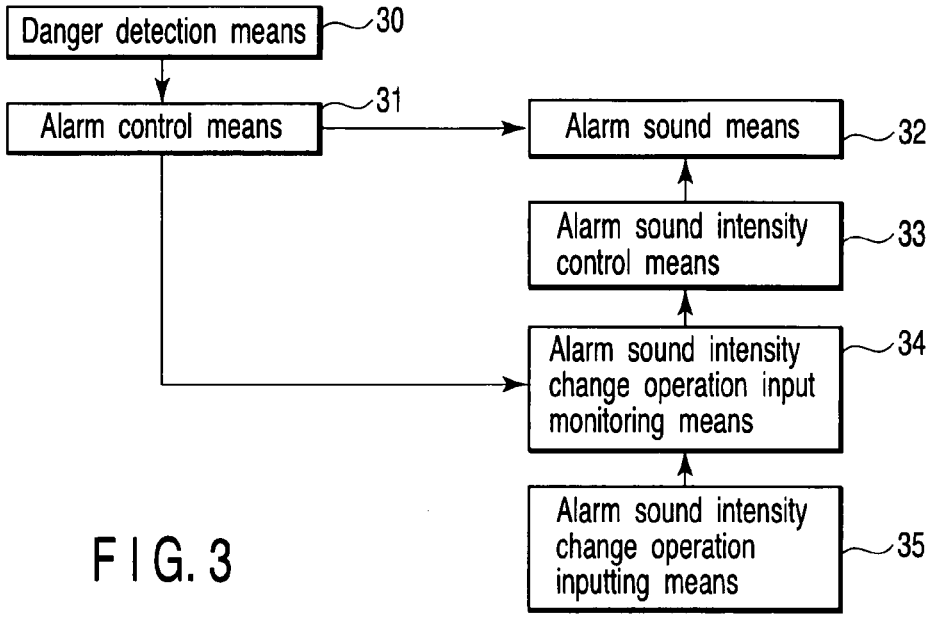
FIG. 3 is an exemplary block diagram showing functions according to the first embodiment of the present invention.
Figure 4:
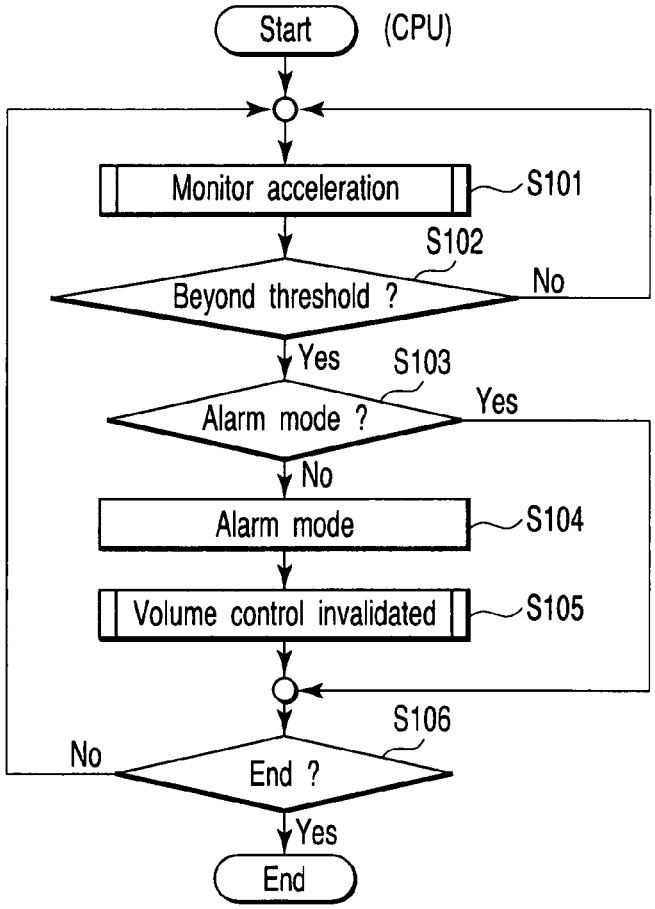
FIG. 4 is an exemplary flowchart of a control method to which the information processing apparatus of the present invention is applied according to the embodiment.

Next, FIG. 3 is a block diagram showing functions according to the first embodiment. Danger detection unit (for example, the acceleration sensor) 30 detects a serious danger and raise an alarm (to call attention) to the user of the computer 10 (hereinafter simply called the user). Alarm control unit (for example, vibration alarm software) 31 conducts the control of start and stop of an important alarm (notice), and the control of validation/invalidation of alarm sound intensity change. Alarm sound unit (for example, the sound card and speaker) 32 raises an alarm to the user of the computer 10. Alarm sound intensity control unit (for example, volume control software) 33 sets and controls the alarm sound intensity (sets the intensity according to the attention degree of the alarm) in accordance with an instruction from alarm sound intensity change operation input monitoring unit (for example, the button controller: EC/KBC 27) 34. The alarm sound intensity change operation input monitoring unit 34 monitors whether or not an operation of changing the alarm sound intensity has been conducted by the user of the computer 10, via alarm sound intensity change operation inputting unit (for example, the volume control button or volume control key) 35. The alarm sound intensity change operation inputting unit 35 accepts the user's operation of changing the alarm sound intensity.

When the danger detection unit 30 detects a dander of which the user of the computer 10 should be notified as an alarm, in the above structure, the alarm control unit 31 directs the alarm sound intensity change operation input monitoring unit 34 to neglect (invalidate) the input from the alarm sound intensity change operation inputting unit 35 and directs the alarm sound unit 32 to start generation of an important alarm sound. When the generation of the alarm sound is ended, the alarm control unit 31 directs the alarm sound unit 32 to stop the generation of an important alarm sound and directs the alarm sound intensity change operation input monitoring unit 34 to accept (validate) the input from the alarm sound intensity change operation inputting unit 35.

Next, a control method to which the information processing apparatus of the present invention is applied will be described with reference to flowcharts in FIG. 4 to FIG. 7. In the present embodiment, the speaker 29 outputting sounds (or voice) is described as the notice unit. However, light emitting unit (light emitting device) of the LED or the like, vibration generated by a vibrator, and the like can also be employed as the notice unit, but the notice unit is not limited to this.

In general, the computer 10 can adjust the volume of sounds output from the speaker by the volume control button 18. In this state, the CPU 20 loads a predetermined application, for example, vibration alarm software on the main memory 24 from the HDD 25 and starts the vibration alarm software. The vibration alarm software starts monitoring by the acceleration sensor 28 (block S101). The acceleration monitoring is started by using a notice of polling, event, interruption and the like employing a timer as a trigger.

The vibration alarm software discriminates whether or not the acceleration detected by the acceleration sensor 28 is equal to or higher than a predetermined acceleration (block S102). When it is discriminated by the vibration alarm software that the acceleration detected by the acceleration sensor 28 is equal to or higher than the predetermined threshold value (YES in block S102), if the vibration alarm software does not shift to a state of sounding am alarm (alarm mode) (NO in block S103), the vibration alarm software shifts to the alarm mode (block S104). The current mode information is stored in the HDD 25 and the like.

The vibration alarm software directs the button controller (EC/KBC 27) of the volume control button 18 to "neglect pushing of the volume control button in the following block S" (block S105), directs the sound card to sound an alarm (i.e. send a notice) at a maximum sound level, and sounds an alarm from the speaker 29 to notify the user of the computer 10 that the vibration of the computer 10 has been detected (i.e. the acceleration has been higher than a predetermined threshold value). In other words, an alarm is output from the speaker 29 serving as the notice unit, irrespective of the setting of the intensity of the volume control (execution unit). Once the vibration alarm software shifts to the alarm mode, changing the volume (pushing down the volume control button) operated by the user of the computer 10 is invalidated (cf. block S105). Therefore the volume cannot be changed. When the user of the computer 10 directs the vibration alarm software to end monitoring the acceleration (YES in block S106), the vibration alarm software ends monitoring.

Next, the processing in a case the state of the computer 10 is the alarm mode is described with reference to FIG. 5.

Figure 6:
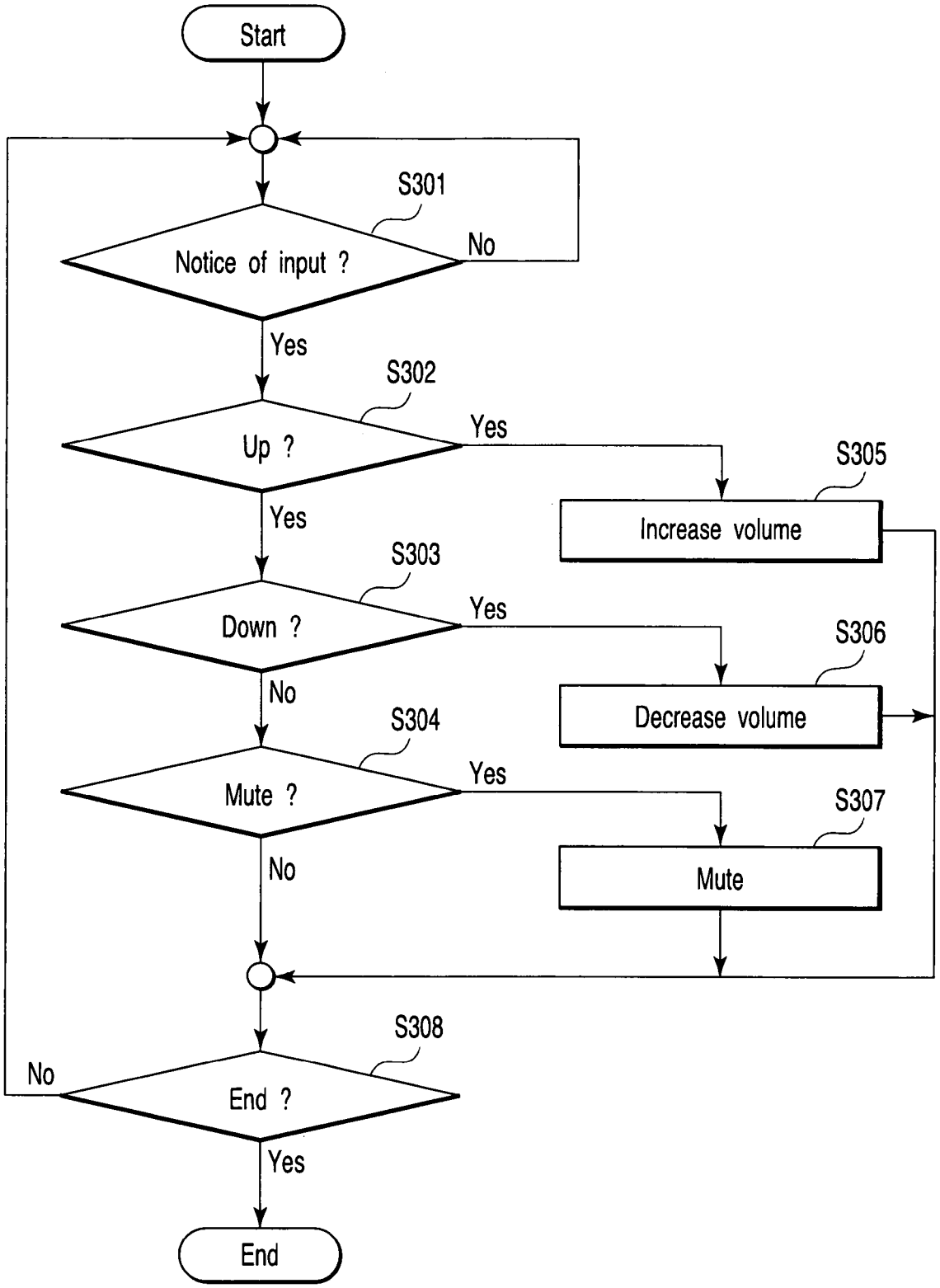
FIG. 6 is an exemplary flowchart of a processing in a case where the computer according to the first embodiment of the present invention is in the alarm mode.

When the state of the computer 10 is the alarm mode, the alarm is canceled, for example, input from the volume control button 18 or the software button is conducted by the user of the computer 10 (block S201). If it is discriminated by the EC/KBC 27 that this input has been conducted (YES in block S202), the operation shifts to block S203. In block S203, the alarm mode (invalidation) or the general mode (validation) is discriminated by the EC/KBC 27 (block S203). If it is discriminated that the volume change is invalidated in the state shown in FIG. 4 (YES in block S203), inputting the volume control by the user is neglected. On the other hand, if it is discriminated in block S203 by the EC/KBC 27 that the volume change is not invalidated (NO in block S203), the button controller is notified of the input of the volume control from the user to conduct the volume control (block S204). In a case where the button controller is notified of the input of the volume control from the user, when the CPU 20 discriminates that the button controller has been notified of the input of the volume control from the user as shown in FIG. 6 (YES in block S301), if the volume control indicates Up (YES in block S302), the control to increase the volume is conducted (block S305). If the volume control indicates Down (YES in block S303), the control to decrease the volume is conducted (block S306). If the volume control indicates Mute (YES in block S304), the control to stop the sounds is conducted (block S307). If the user directs stopping, the volume control is ended (YES in block S308).

Figure 7:
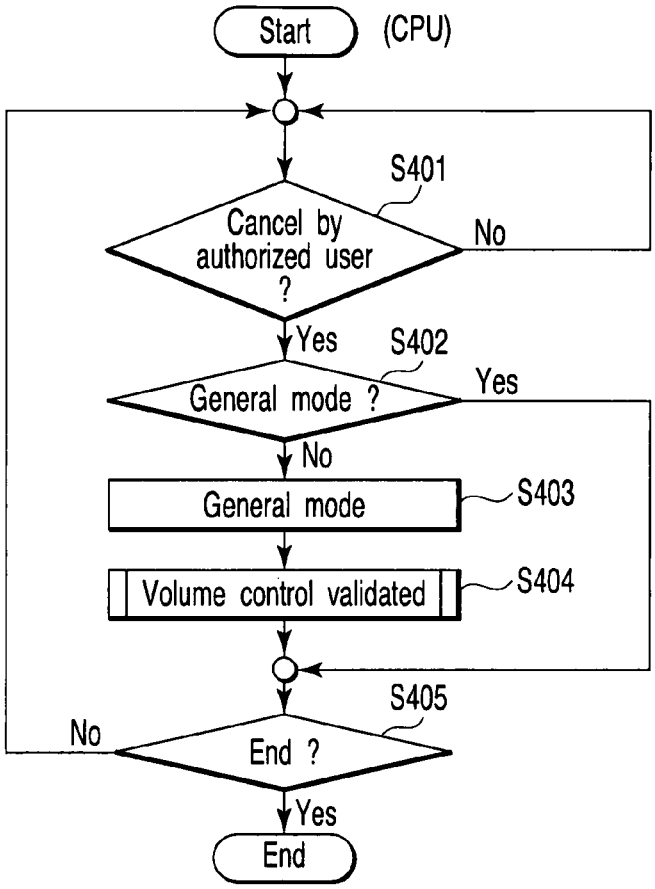
FIG. 7 is an exemplary flowchart of a processing in a case where the computer state is shifted from the alarm mode to a general mode according to the embodiment.

Next, a processing of shifting the state of the computer 10 from the alarm mode to the general mode is described with reference to FIG. 7.

As for the alarm releasing, the processing is started by employing the notice such as polling, event, interruption or the like using a timer as a trigger.

The CPU 20 discriminates whether or not the user to cancel the alarm is an authorized user (i.e. user permitted to cancel) (block S401). For the discrimination, for example, a password is input. If the user is not the authorized user (NO in block S401), the operation returns to block S401 since the alarm cannot be canceled, and the state of sounding an alarm still continues. On the other hand, if it is discriminated by the CPU 20 that the alarm has been canceled by the authorized user (for example, matching the passwords: YES in block S401), the CPU 20 discriminates whether or not an alarm is currently sounded. In other words, the CPU 20 discriminates whether or not the state of the computer 10 is the general mode (block S402). The discrimination is conducted by reading the mode information stored in the HDD 25 or the like. If it is discriminated by the CPU 20 that the state of the computer 10 is the "general mode" in which an alarm is not sounded (YES in block S402), the operation returns to block S101 since particular processing does not need to be conducted. On the other hand, if it is discriminated by the CPU 20 that the state of the computer 10 is not the "general mode" (NO in block S402), the CPU 20 shifts the state of the computer 10 to the "general mode" and stores the mode information in the HDD 25 or the like (block S403). After shifting to the "general mode", the CPU 20 validates again the volume change operation (volume control) (block S404), stops the alarm, and returns the setting of intensity associated with the attention degree of alarm of the volume to the previous state of the "general mode". In other words, the vibration alarm software directs the sound card to stop sound an alarm to return to the state of sounding no alarm (general mode) and directs the button controller "not to neglect the pushing of the volume control button in the following block S". In the general mode, the volume can be adjusted as conducted in the general-state computer 10. On the basis of the stop direction from the user, the volume control is ended (YES in block S405).

According to the above embodiment, an important notice can be sent at the maximum volume at any time, irrespective of the setting of the volume of the speaker 29 serving as the notice unit. In other words, the volume state can be managed integrally on the software by controlling the volume change operation by the software. According to the conventional volume management using the software, if the "vibration detection alarm" is implemented without an especial system, the user can decrease the volume of the vibration alarm and cannot understand the relevant operation by the software. According to the "vibration detection alarm", when the vibration is detected, it is possible to continue sounding an alarm in a state in which the alarm volume cannot be changed and, therefore, the alarm can be notified certainly to the surrounding. At this time, since an unauthorized user cannot decrease the volume, theft can also be prevented. Thus, when the volume control is implemented by the software, the state of being incapable of conducting the volume change under specific circumstances can be formed.

Second Embodiment

Figure 8:
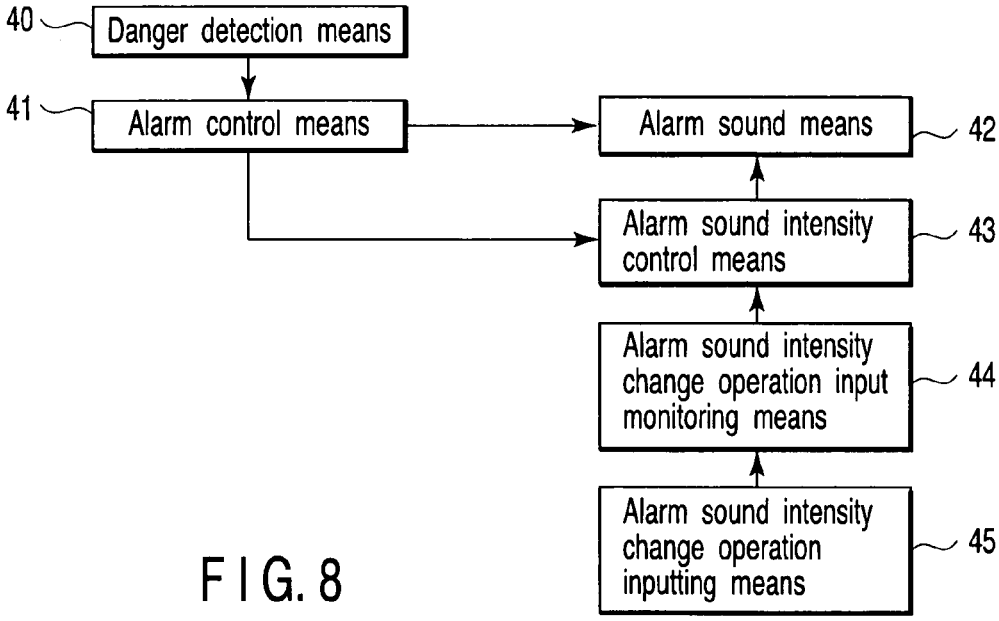
FIG. 8 is an exemplary block diagram showing functions according to a second embodiment of the present invention.

Next, FIG. 8 is a block diagram showing functions according to the second embodiment of the present invention.

Danger detection unit 40, alarm control unit 41, alarm sound unit 42, alarm sound intensity control unit 43, alarm sound intensity change operation input monitoring unit 44 and alarm sound intensity change operation inputting unit 45 correspond to the danger detection unit 30, the alarm control unit 31, the alarm sound unit 32, the alarm sound intensity control unit 33, the alarm sound intensity change operation input monitoring unit 34 and the alarm sound intensity change operation inputting unit 35 of the first embodiment, respectively. A difference between the second embodiment and the first embodiment is that a direction from the alarm control unit 41 is sent to the alarm sound unit 42 and the alarm sound intensity control unit 43 (while the direction from the alarm control unit 31 is sent to the alarm sound unit 32 and the alarm sound intensity change operation input monitoring unit 34). In other words, the CPU 20 discriminates whether or not the current mode is the alarm mode or the general mode in the first embodiment (FIG. 5 and FIG. 6) while the EC/KBC 27 discriminates whether or not the current mode is the alarm mode or the general mode in the second embodiment (FIG. 9 and FIG. 10).

Figure 5:
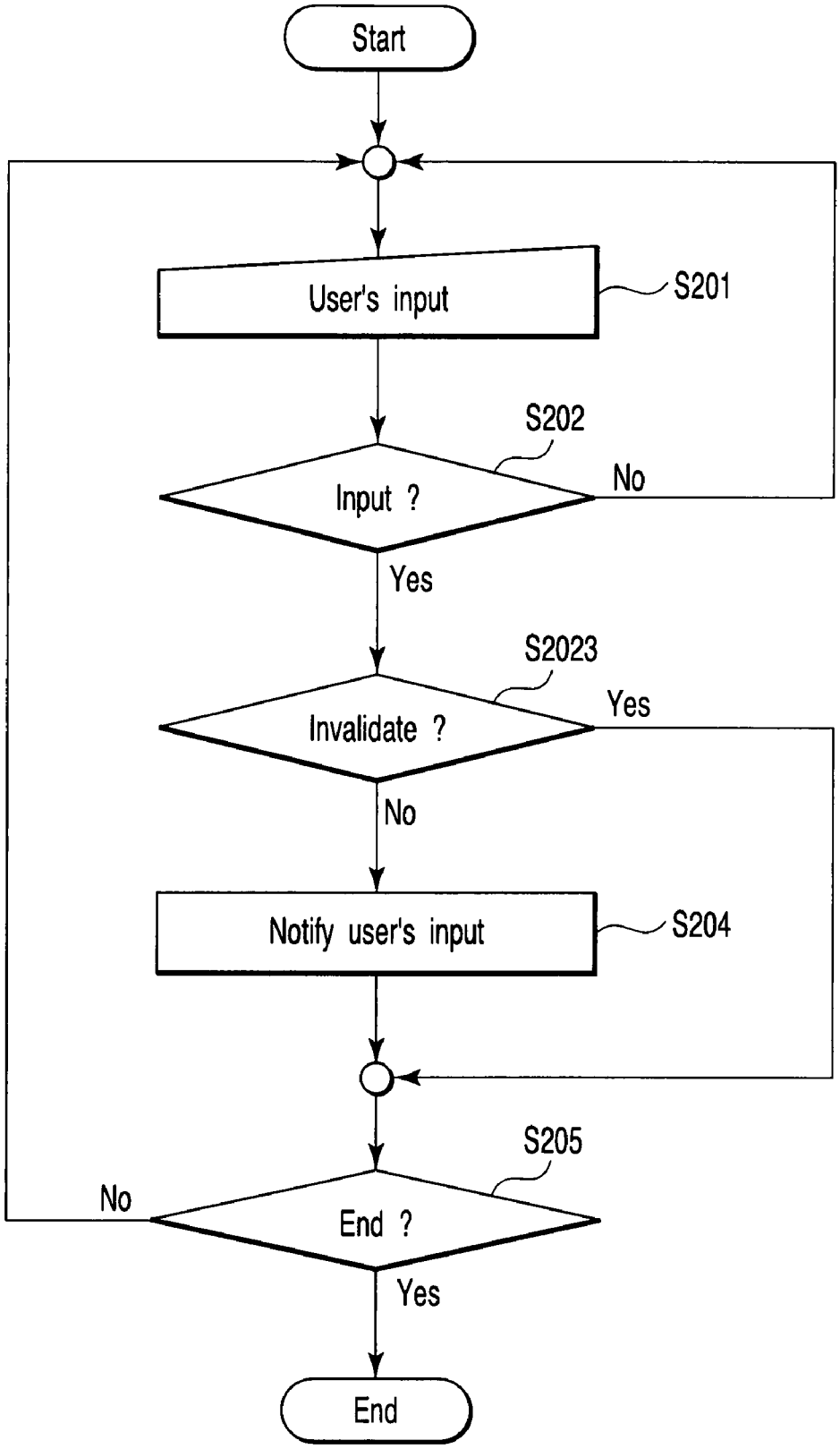
FIG. 5 is an exemplary flowchart of a processing in a case where a computer according to the first embodiment of the present invention is in an alarm mode.
Figure 9:
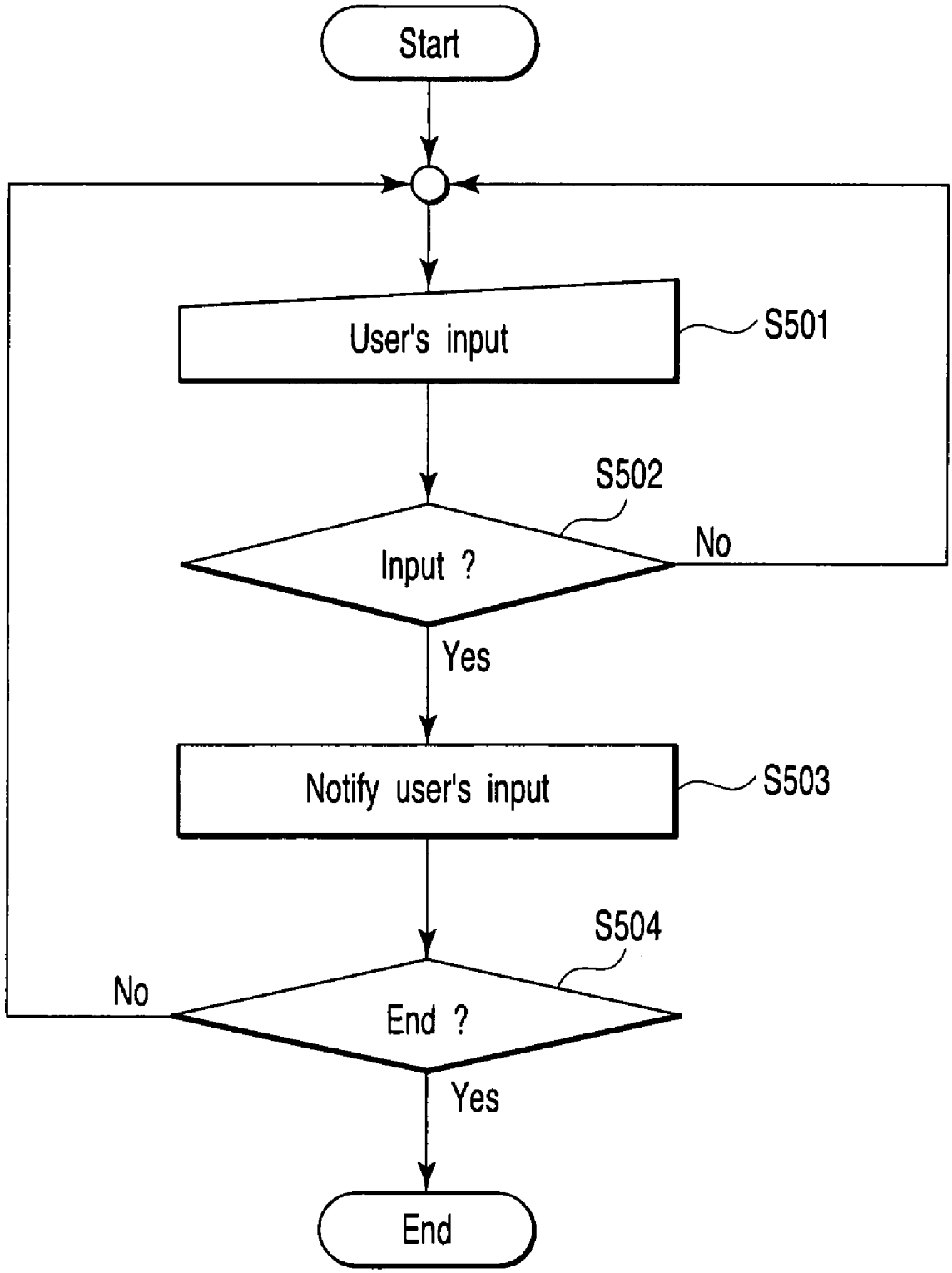
FIG. 9 is an exemplary flowchart of a processing in a case where a computer according to the second embodiment of the present invention is in an alarm mode.
Figure 10:
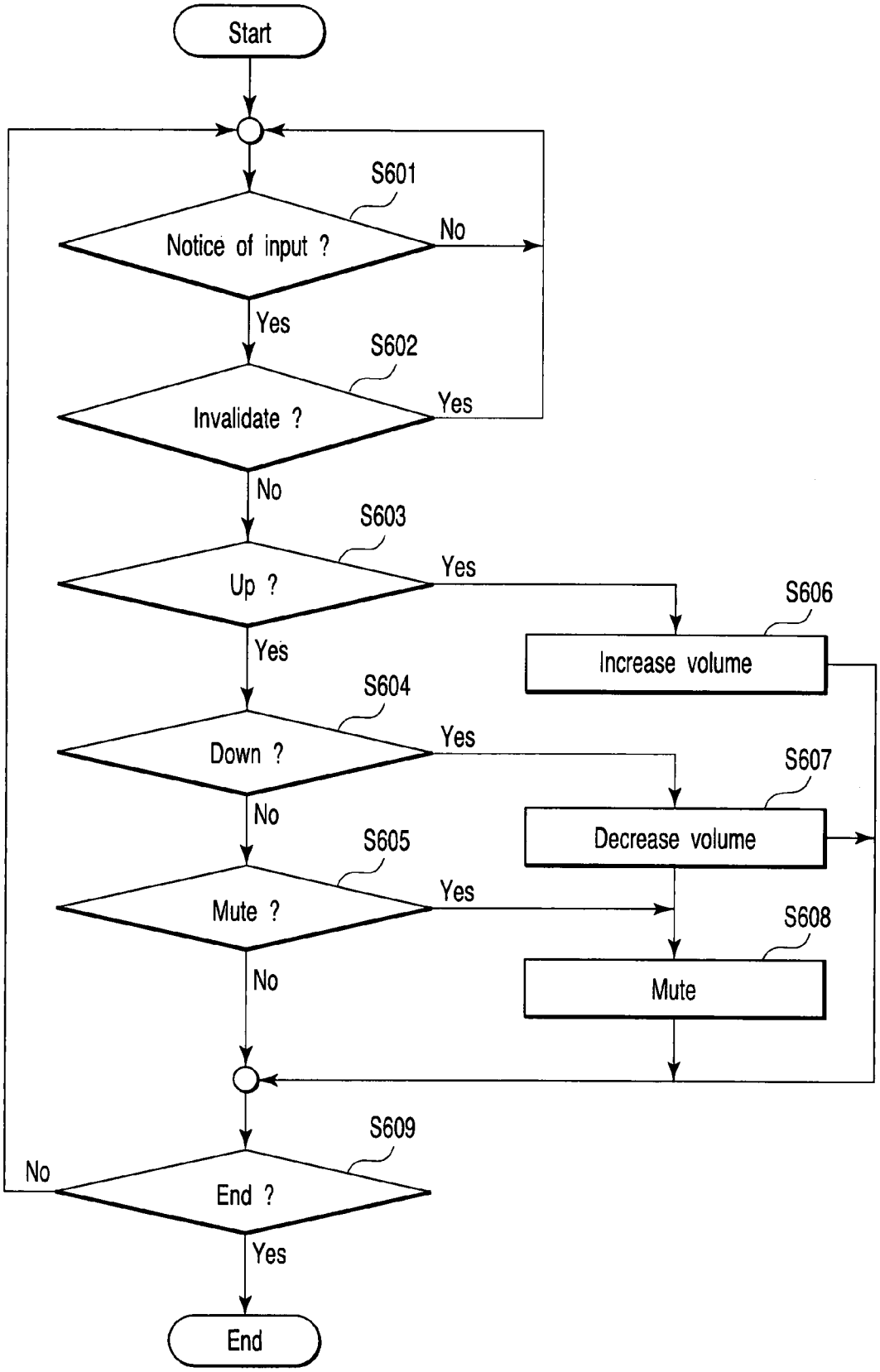
FIG. 10 is an exemplary flowchart of a processing in a case where the computer according to the second embodiment of the present invention is in the alarm mode.

For example, a flowchart of FIG. 9 does not include the discrimination step of discriminating whether or not the current mode is the alarm mode or the general mode (block S203) shown in FIG. 5. On the other hand, the discrimination step of discriminating whether or not the current mode is the alarm mode or the general mode (block S602) is added to a flowchart of FIG. 10. If the volume change is not invalidated (NO in block S602), the volume control is conducted.

By employing the second embodiment, the same advantage as that of the first embodiment can be obtained.

In addition, as a modified embodiment, the alarm notice is generated by using the sounds from the speaker in the above embodiments. Besides this, the notice can also be sent by the lighting of a light emitting device such as an LED or the like or the vibration generated by the vibrator, or they may be employed in combination. In other words, if an acceleration higher than a preset value is detected, the light is emitted by the LED or the vibration is generated by the vibrator, at a preset value of the intensity, irrespective of the setting of lighting of the LED or the setting (ON/OFF) of generating the vibration by the vibrator.

The present invention is not limited to the embodiments described above but the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An information processing apparatus, comprising:

a notice unit configured to raise an alarm to call attention;

a control unit configured to set an intensity level associated with an attention degree of the alarm of the notice unit;

a detection unit configured to detect a predetermined state; and an execution unit configured to urge the notice unit to output the alarm, irrespective of the intensity level set by the control unit, if the predetermined state is detected by the detection unit.

2. The apparatus according to claim 1, wherein the detection unit is an acceleration sensor and the predetermined state is a state in which an acceleration higher than a predetermined value is detected by the acceleration sensor.

3. The apparatus according to claim 1, wherein the notice unit is a speaker configured to output sounds and, if an acceleration higher than a predetermined value is detected by the acceleration sensor, a notice is sent from the speaker at a predetermined volume, irrespective of setting the intensity of volume of an output of the speaker by the control unit.

4. The apparatus according to claim 1, wherein the notice unit is a vibrator configured to generate vibration and, if an acceleration higher than a predetermined value is detected by the acceleration sensor, a notice is sent by vibrating the vibrator at a predetermined intensity, irrespective of setting the vibration of the vibrator by the control unit.

5. The apparatus according to claim 1, wherein the notice unit is a light emitting device and, if an acceleration higher than a predetermined value is detected by the acceleration sensor, a notice is sent by light of the light emitting device, irrespective of setting concerning a light emission control of the light emitting device by the control unit.

6. A method of controlling a notice of alarm to call attention, comprising:

upon raising the alarm to call attention, invalidating a setting of an intensity level associated with an attention degree of the alarm, if a predetermined state is detected; and outputting the alarm at a predetermined intensity, irrespective of the intensity level setting.

7. The method according to claim 6, wherein the predetermined state is a state in which an acceleration higher than a predetermined value is detected.

8. The method according to claim 6, wherein if an acceleration higher than a predetermined value is detected, a setting of intensity of volume upon sending a notice by sounds output from a speaker is invalidated and, irrespective of the setting, the notice is sent at a predetermined volume.

9. The method according to claim 6, wherein if an acceleration higher than a predetermined value is detected, a setting of intensity of vibration generated by a vibrator is invalidated and, irrespective of the setting, the notice is sent by generating the vibration at a predetermined intensity.

10. The method according to claim 6, wherein if an acceleration higher than a predetermined value is detected, a setting concerning a light emission control of a light emitting device is invalidated and, irrespective of the setting, the notice is sent by lighting of the light emitting device.

* * * * *